US008869906B2

(12) United States Patent
Thompson

(10) Patent No.: US 8,869,906 B2
(45) Date of Patent: Oct. 28, 2014

(54) DEFLECTOR CARRIER

(75) Inventor: Andrew T. Thompson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 724 days.

(21) Appl. No.: 12/711,758

(22) Filed: Feb. 24, 2010

(65) Prior Publication Data

US 2011/0203814 A1 Aug. 25, 2011

(51) Int. Cl.
*A62C 37/00* (2006.01)
*A62C 37/09* (2006.01)

(52) U.S. Cl.
CPC ..... *A62C 37/09* (2013.01)
USPC ..... 169/56; 169/37

(58) Field of Classification Search
CPC ..... A62C 35/00; A62C 37/09; A62C 37/42; A62C 37/00
USPC ..... 169/56, 16, 17, 37, 41, 42, 57, 38, 39
See application file for complete search history.

(56) References Cited

U.S. PATENT DOCUMENTS

| | | | | |
|---|---|---|---|---|
| 2,558,450 | A | 6/1951 | Martin | |
| 3,633,676 | A | 1/1972 | Gloeckler | |
| 4,014,388 | A * | 3/1977 | Anderson | 169/37 |
| 4,066,129 | A | 1/1978 | Anderson | |
| 4,880,063 | A | 11/1989 | Leininger et al. | |
| 4,976,320 | A | 12/1990 | Polan | |
| 5,083,616 | A | 1/1992 | Polan | |
| 5,152,344 | A | 10/1992 | Fischer et al. | |
| 5,664,630 | A | 9/1997 | Meyer et al. | |
| 5,829,532 | A * | 11/1998 | Meyer et al. | 169/37 |
| 6,082,463 | A | 7/2000 | Ponte | |
| 6,129,153 | A | 10/2000 | Joung | |
| 6,152,236 | A | 11/2000 | Retzloff et al. | |
| 6,367,559 | B1 | 4/2002 | Winebrenner | |
| 6,520,265 | B2 | 2/2003 | Winebrenner | |
| 6,554,077 | B2 * | 4/2003 | Polan | 169/57 |
| 6,808,128 | B2 * | 10/2004 | Naugler et al. | 239/209 |
| 7,275,603 | B2 | 10/2007 | Polan | |
| 2006/0219817 | A1 | 10/2006 | Franson et al. | |
| 2009/0056958 | A1 | 3/2009 | Polan | |
| 2009/0126950 | A1 | 5/2009 | Rogers | |

FOREIGN PATENT DOCUMENTS

| | | | |
|---|---|---|---|
| CN | 101184554 | A | 5/2008 |

* cited by examiner

*Primary Examiner* — Davis Hwu
(74) *Attorney, Agent, or Firm* — Harness, Dickey & Pierce, P.L.C.

(57) ABSTRACT

A sprinkler according to the present disclosure has a movable deflector that is spaced apart from its supporting pins by a carrier member. The spacing apart of the deflector from the pins may allow for the distribution pattern of the fire suppressant to be of a higher quality and reduce and/or minimize the possibility of voids or discontinuities in the distribution pattern.

20 Claims, 6 Drawing Sheets

FIG 1
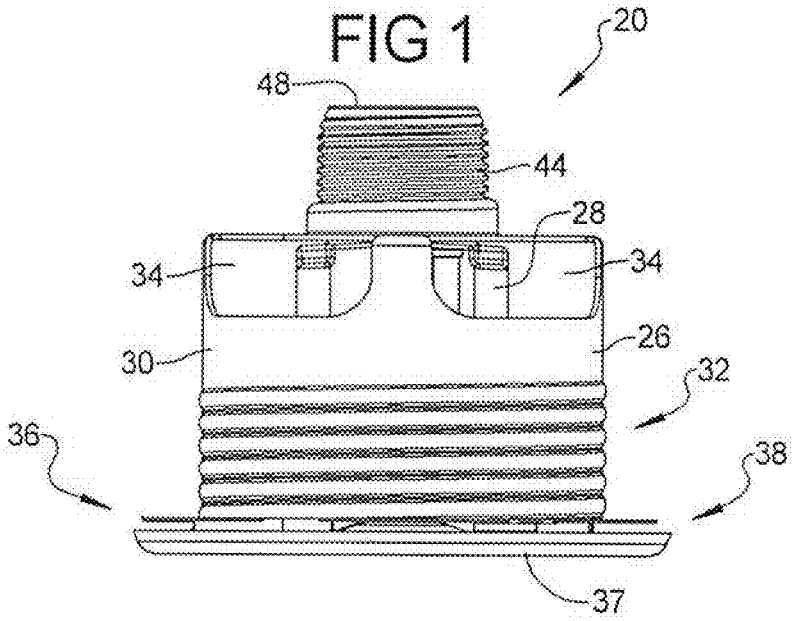
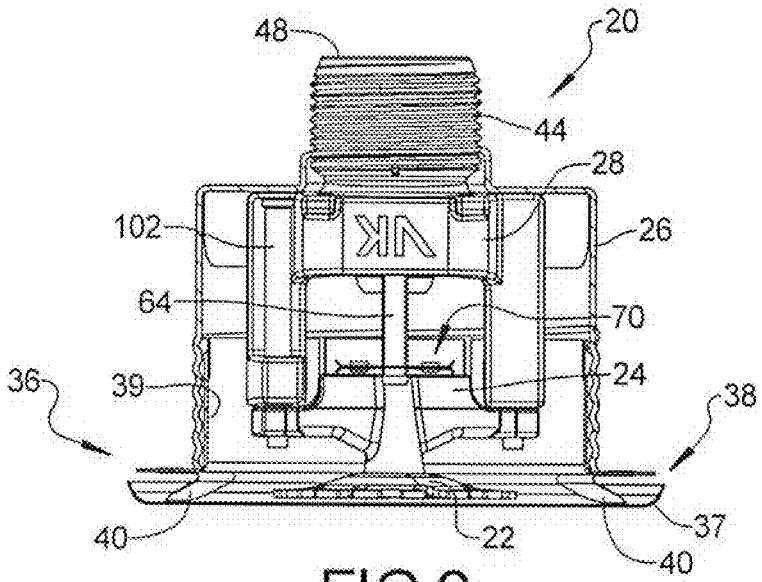
FIG 2

FIG 3
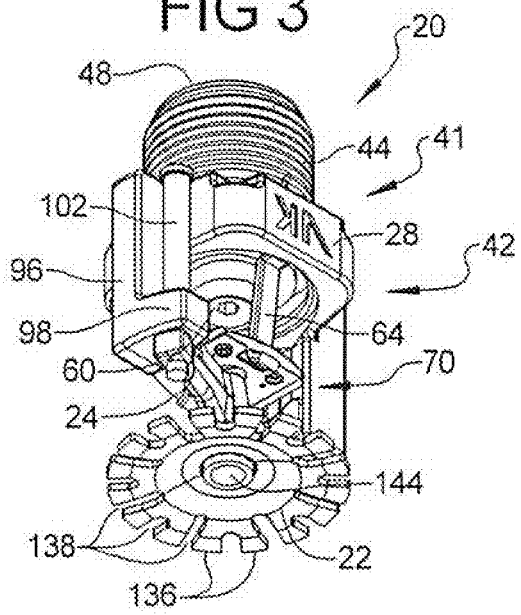
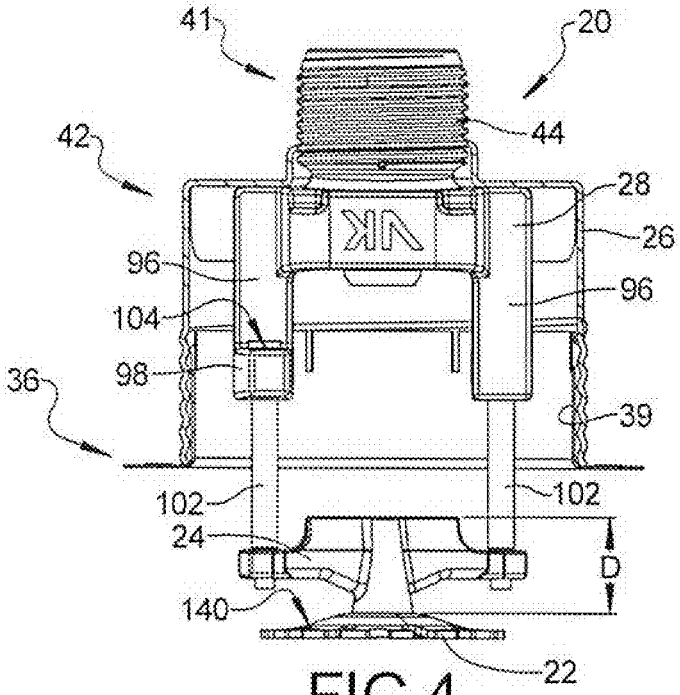
FIG 4

FIG 5
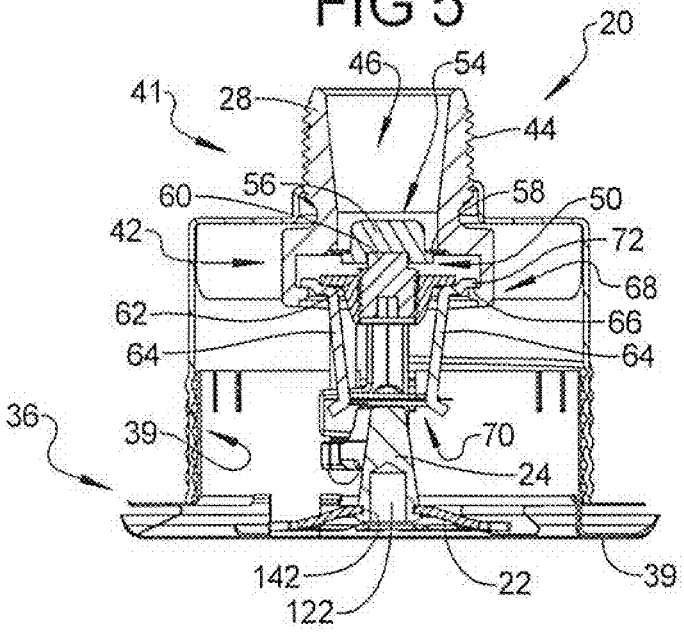
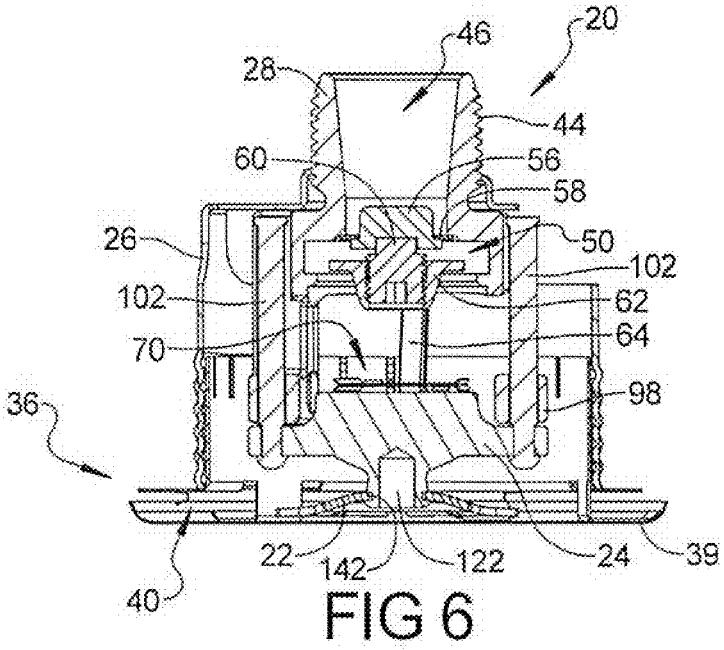
FIG 6

FIG 7
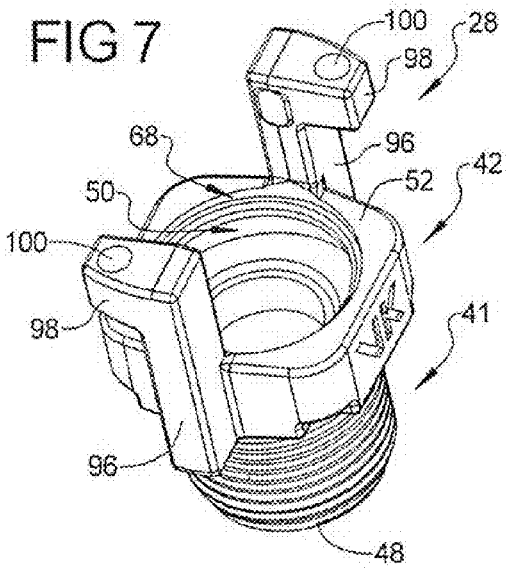
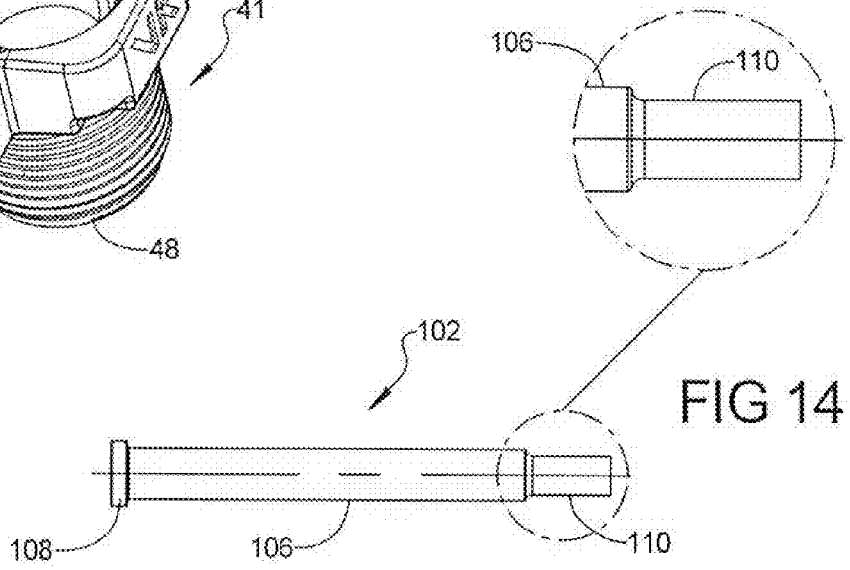
FIG 14
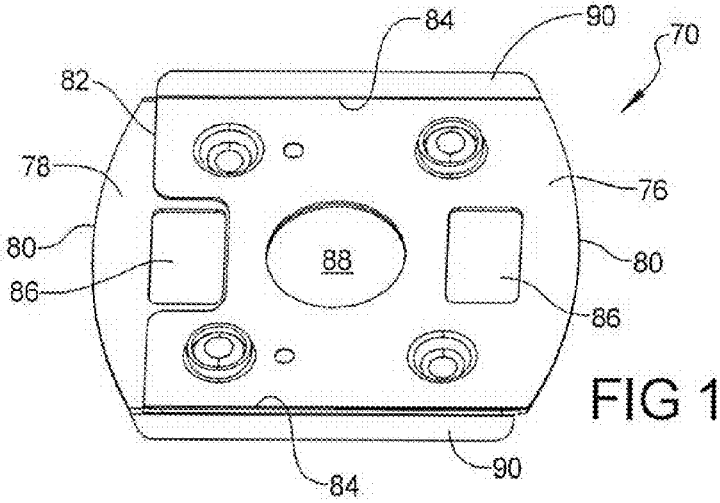
FIG 15

FIG 8
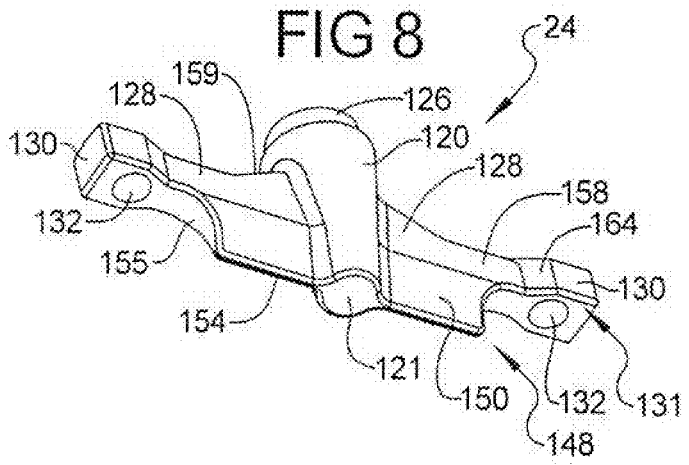
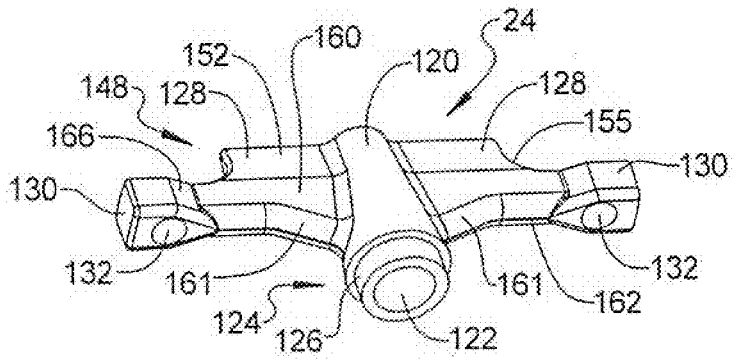
FIG 9
FIG 10
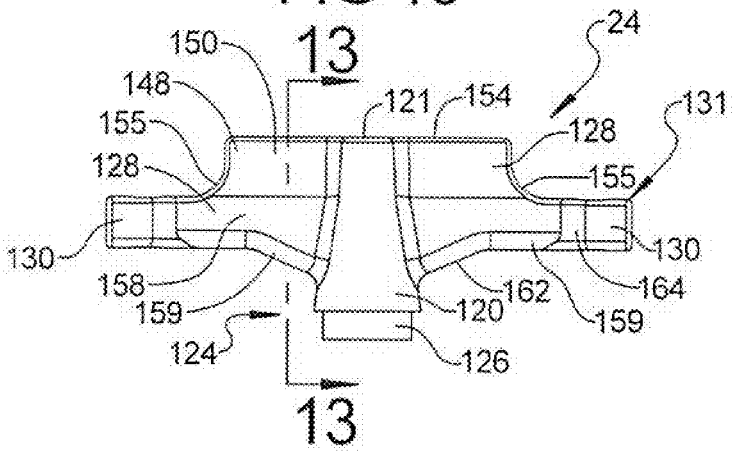

FIG 11
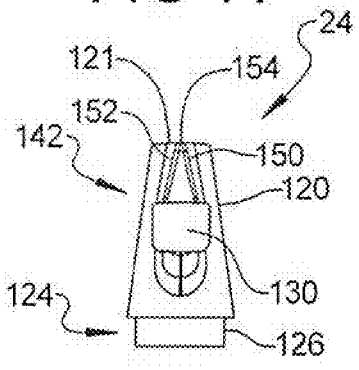
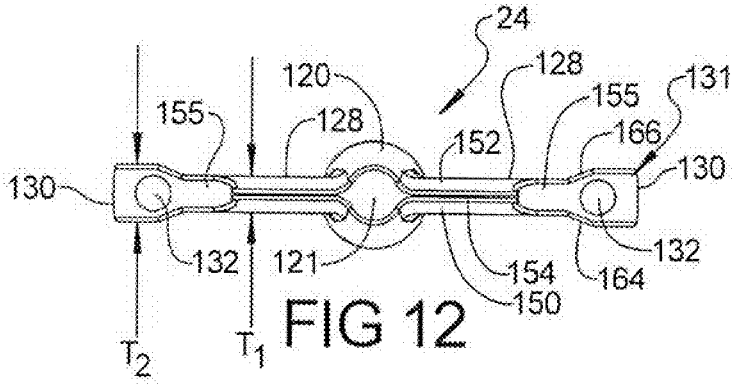
FIG 12
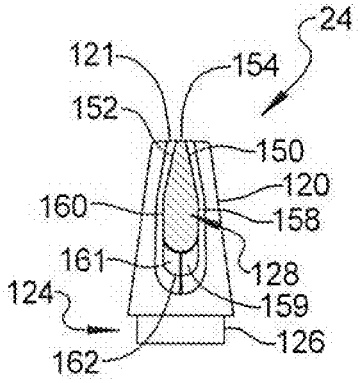
FIG 13

DEFLECTOR CARRIER

FIELD

The present disclosure relates to fire protection sprinklers used in automatic fire extinguishing systems for buildings and the like and, in particular, to a deflector carrier for a sprinkler.

BACKGROUND AND SUMMARY

This section provides background information related to the present disclosure which is not necessarily prior art.

Sprinklers have long been used in automatic fire extinguishing systems in order to controllably disburse a fluid to suppress or extinguish a fire in a designated area. The sprinkler may be either exposed or concealed. The use of a concealed sprinkler can provide an aesthetically pleasing appearance for the automatic fire extinguishing system.

The concealed sprinklers typically include a cover and a release mechanism. When the release mechanism is activated, the cover may be released and a deflector drops down to be spaced below the ceiling. The deflector is typically circular in nature and deflects the fire suppressant into a desired distribution pattern. The displaceable deflector is attached to the sprinkler by pins that can translate relative to the sprinkler. The pins can be attached directly to the deflector adjacent opposing edges. The pins can cause the fire suppressant to part as it flows around and past the pins. As a result, the pins can cause a shadow effect wherein there may be voids in the distribution pattern behind the pins. The deflector may include geometry beyond the pins that attempts to redirect the fire suppressant to fill in the voids in the distribution pattern. However, these efforts typically result in a distribution pattern that is still lacking.

In exposed sprinklers, the deflector is attached to fixed frame arms in a location spaced below the ceiling. The frame arms may also reduce the quality of the distribution pattern of the fire suppressant. However, the reduction in the quality of the distribution pattern is usually not nearly as pronounced as with the disruption of the distribution pattern behind the pins of a concealed sprinkler.

The disruption in the distribution pattern can be amplified in sprinklers having a larger K factor. In particular, the size of the pins required to support the deflector against the force of the fire suppressant increases with an increasing K factor. The larger pins can have a greater disruptive impact on the distribution pattern than smaller pins.

Thus, it would be advantageous to provide a concealed sprinkler design wherein the deflector is movable relative to the sprinkler frame. Furthermore, it would be desirable if the deflector produced a quality distribution pattern. Moreover, it would be advantageous to reduce the possibility of voids in the distribution pattern. Additionally, it would be advantageous if a concealed sprinkler design can be utilized with sprinklers having a larger K factor and a quality distribution pattern produced.

A sprinkler according to the present disclosure has a movable deflector that is spaced apart from the movable pins. The spacing apart of the deflector from the pins may allow for the distribution pattern of the fire suppressant to be of a higher quality and reduce and/or minimize the possibility of voids or discontinuities in the distribution pattern.

An automatic fire protection sprinkler according to the present disclosure includes a deflector carrier axially moveable relative to a sprinkler body outlet through which fire suppressant fluid flows. The deflector carrier is movable axially between a first position distal of the outlet and a second position distal of the first position. The deflector carrier has a radially extending leading edge facing the outlet and a mounting location distal of the leading edge. At least one guide member is movably coupled to the sprinkler body and has axially opposite first and second ends. The at least one guide member is coupled to the deflector carrier at the mounting location and movably couples the deflector carrier to the sprinkler body. The at least one guide member can move with movement of the deflector carrier between the first and second positions. A deflector is attached to the deflector carrier and moves with the deflector carrier between the first and second positions. The deflector distributes fire suppressant fluid thereon into a flow distribution pattern. The deflector carrier maintains the deflector distally spaced away from and downstream of the at least one guide member. The leading edge is closer to the outlet than the mounting location in both of the first and second positions.

In some embodiments, the deflector carrier includes a central section and a pair of wings extending radially outwardly from the central section in opposite directions. The wings each have an end section that together define a pair of mounting locations to which a pair of guide members are coupled. The wings each have an uppermost section defined by a pair of radially spaced apart surfaces that taper toward one another as they extend axially toward the outlet and define a leading edge. The wings each have a lowermost section defined by a pair of radially spaced apart surfaces that taper toward one another as they extend axially away from the outlet and define a trailing edge. Each of the wings includes a pair of radially spaced apart, intermediate, generally parallel planar surfaces between the uppermost and lowermost sections.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a plan view of a fire protection sprinkler according to the present disclosure in the storage position;

FIG. 2 is a plan view of the sprinkler of FIG. 1 with the cup fragmented;

FIG. 3 is a perspective view of the sprinkler of FIG. 2 with the cup and cover removed;

FIG. 4 is a plan view of the sprinkler of FIG. 2 in an activated position;

FIGS. 5 and 6 are cross-sectional views taken 90° offset, respectively, of the sprinkler of FIG. 1;

FIG. 7 is a perspective view of the sprinkler body of the sprinkler;

FIGS. 8 and 9 are perspective views of the deflector carrier according to the present disclosure;

FIGS. 10 and 11 are front and side plan views of the deflector carrier of FIG. 8;

FIG. 12 is a top view of the deflector carrier of FIG. 8;

FIG. 13 is a cross-sectional view along line 13-13 of FIG. 10;

FIG. 14 is a plan view of the pin of the sprinkler; and

FIG. 15 is a perspective view of the trigger assembly of the sprinkler.

Corresponding reference numerals indicate corresponding parts throughout the several views of the drawings.

DETAILED DESCRIPTION

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure is embodied in a unique concealed sprinkler 20 having a movable deflector 22 which is attached to sprinkler 20 by a deflector carrier 24. The use of deflector carrier 24 provides an improved quality for the distribution pattern of a fire suppressant as it flows off deflector 22.

Referring to FIGS. 1-6, a concealed automatic sprinkler 20 normally contains a cup 26 that surrounds a body 28 and forms an outer housing with an interior in which body 28 and other components are located. Cup 26 may have an exterior surface 30 which may include a section of rolled threads 32. Threads 32 can facilitate the engagement of a cover 36 thereto. Cup 26 may include a plurality of openings 34 to allow air flow around sprinkler 20.

Cover 36 can be a multi-piece assembly and may include a cover plate 37 and a sleeve 39. Sleeve 39 may have rolled threads complementary to threads 32 and cover 36 may be threaded into cup 26. Plate 37 can be attached to sleeve 39 with clip springs and heat-fusible material. Heat-fusible materials, often entitled heat-sensitive materials, are generally known in the automatic sprinkler industry and, thus, the heat-fusible material may be any generally recognized material used in the art possessing the requisite degree of bonding strength and thermal sensitivity. The actual heat-fusible material chosen for use with cover assembly 36 depends upon the temperature at which it is desired to have plate 37 fall away from cup 26. For example purposes only, the heat-fusible material may be solder or a thermally sensitive adhesive.

Plate 37 may be generally circular in plan view and can provide an aesthetically pleasing appearance and hide sprinkler 20 from view. A gap 38, which may be annular by way of non-limiting example, can exist between the top of plate 37 and the end of cup 26. Gap 38 can allow air flow to circulate within cup 26 in fluid contact with responsive trigger devices therein. Plate 37 can include a plurality of vents/louvers/holes 40 that also facilitate air circulation throughout the interior of cup 26. The holes 40 and/or gap 38 can be configured to provide a desired responsive characteristic. The components of cover assembly 36 may be made from any thermally conductive material commonly employed in the art.

Body 28 of sprinkler 20 may be a one-piece body, as shown, or a multi-piece assembly. Body 28 includes an upper portion 41 and a lower portion 42. Upper portion 41 includes upper external threads 44, allowing removable attachment with a pipe positioned within the ceiling (not shown). This pipe is in fluid communication with a source of pressurized water or other fire extinguishing fluid. Upper portion 41 includes an interior passageway 46 that extends from a first end 48 of body 28 and terminates into a second interior passageway 50 in lower portion 42. The second interior passageway 50 extends from first interior passageway 46 to a second end 52 of body 28. Second interior passageway 50 can have a larger diameter than that of first interior passageway 46. A seal closure assembly 54 is disposed within second interior passageway 50 and forms a fluid-tight seal against a lower seat of upper portion 41 thereby blocking fluid flow through first interior passageway 46. Seal closure assembly 54 includes a plug 56 having an upper shoulder upon which a sealing washer 58 is located. Sealing washer 58 engages with the shoulder of plug 56 and with the lower seat of upper portion 41. Seal closure assembly 54 is in fluid communication with first interior passageway 46 and, when compressed against the lower seat of upper portion 41, forms a fluid-tight seal.

An adjustment screw 60 is threaded through a central bore in an adjustment plate 62 and presses upwardly against a recess in plug 56. Upper ends of a pair of spring-biased actuators or levers 64 are seated above a lip 66 formed about a bottom region 68 of second interior passageway 50. Levers 64 extend beneath adjustment plate 62 and hold adjustment plate 62 in place. A trigger device 70 prevents levers 64 from separating. With adjustment plate 62 so secured, the turning of adjustment screw 60 adjusts the closure pressure on seal closure assembly 54.

Levers 64 are biased in the outward position and depend a pre-selected distance below the bottom region of body 28. Each lever 64 has a substantially horizontal ledge 72 for supporting the periphery of adjustment plate 62. Seal closure assembly 54 extends a pre-selected distance within the second interior passageway 50 of body 28.

Turning now to FIGS. 2-3, 5-6, and 15, trigger device 70 includes a first fusible plate 76 and a second fusible plate 78 joined by a heat-fusible material. The heat-fusible material can be the same or similar to that discussed above. The actual heat-fusible material chosen for use with trigger device 70 depends upon the temperature at which activation of sprinkler 20 is desired. For example purposes only, the heat-fusible material may be solder or a thermally sensitive adhesive. The heat-fusible material used in trigger device 70 can be selected to operate at a higher temperature than that used to secure plate 37 to cover assembly 36 to cup 26. In this manner, plate 37 will fall away from cup 26 prior to activation of trigger device 70 which then allows the fire suppressant to flow through body 28, as described below.

Each plate 76, 78 preferably has an eccentric shape defined by a section 80 having a uniform radius, a straight or linear section 82 opposite section 80, and a pair of substantially parallel straight or linear sections 84 extending between sections 80, 82. Plates 76, 78 may be made from any thermally conductive material commonly employed in the art. Each plate 76, 78 contains a first aperture 86 dimensioned to receive one of levers 64. A hole 88 formed in each plate 76, 78 permits one to insert the proper tool therethrough, enabling the tightening or loosening of adjustment screw 60 when in the assembled position. Parallel sections 84 of each plate 76, 78 may be formed with a respective upturned and downturned flange or rim 90. Alternatively, plates 76, 78 may be substantially planar.

When assembled, first plate 76 and second plate 78 are adhered to one another in a partially overlapping position such that straight section 82 of first plate 76 is positioned adjacent uniform radius section 80 of second plate 78. Likewise, straight section 82 of second plate 78 is positioned adjacent uniform radius section 80 of first plate 76. Additionally, parallel sections 84 are aligned with flanges 90 extending away from one another.

With first and second plates 76, 78 attached together, this assembly is coupled to levers 64. Specifically, aperture 86 of first plate 76 receives a lever 64 while another lever 64 is received by aperture 86 of second plate 78. When so assembled, holes 88 of each plate 76, 78 are in co-axial registration, thereby permitting one to insert the proper tool therethrough, as necessary, to tighten or loosen adjustment screw 60. As adjustment screw 60 is tightened, levers 64 are biased radially outwardly by adjustment plate 62 and the resistance of seal closure assembly 54 blocking first interior passageway 46. Plates 76, 78 resist the outward bias of levers 64 and levers 64 thereby retain plates 76, 78 to sprinkler 20.

Referring now to FIGS. 2-7, body 28 includes a pair of frame arms 96 that depend downwardly a pre-selected distance. Each frame arm 96 includes a foot or projection 98 extending outwardly therefrom. Projection 98 can extend generally perpendicularly to frame arm 96. Each projection 98 includes an opening 100 extending therethrough. Opening 100 is configured to receive a movable pin 102 therein. The upper portions of projections 98 include an upper surface 104 that can limit the movement of pins 102, as described below. Frame arms 96 can be spaced about 180° apart on body 28. Projections 98 can extend outwardly from frame arms 96 in opposite directions, as shown. In some embodiments, projections 98 may extend outwardly from frame arm 96 in a same direction (not shown).

Referring now to FIGS. 2-4, 6, and 14, each pin 102 includes a generally cylindrical body 106. Upper end 108 of pin 102 forms a head with a larger radial dimension than that of cylindrical body 106. Cylindrical body 106 is dimensioned to be slidingly received within opening 100 in projections 98 of frame arms 96. Head 108 has a radial dimension greater than a radial dimension of opening 100 such that head 108 can engage with upper surface 104 of projections 98 to limit the downward movement of pins 102 relative to frame arms 96. The lower end 110 of pin 102 is defined by a section of reduced radial dimension relative to that of cylindrical body 106. Lower end 110 of pins 102 are dimensioned to fit within an opening in deflector carrier 24, and to be retained thereto, as described below.

Referring now to FIGS. 2-6 and 8-13, deflector carrier 24 includes a central section 120 which is generally frusto-conical in shape and includes a generally flat upper surface 121 facing the outlet of body 28 and a central section bore 122 open on a lower end 124 thereof. Central section bore 122 may be threaded or non-threaded. Central section 120 radially increases in outer dimension as it extends downwardly. A lower portion 126 of central section 120 has a reduced outer diameter to be received within a hole in deflector 22, as described below. Deflector carrier 24 includes a pair of wings 128 that extend outwardly from central section 120 approximately 180° apart (radially opposite). An end 130 of each wing 128 includes a generally flat surface 131 facing the outlet of body 28 with a hole 132 that extends therethrough generally parallel with bore 122. Holes 132 are configured to receive lower ends 110 of pins 102. Holes 132 may be dimensioned to fit relatively snugly on lower ends 110 of pins 102 to provide a secure engagement therewith. Pins 102 may be secured to ends 130 by a variety of methods. By way of non-limiting example, a rivet may be used to retain pins 102 in ends 130 of wings 128. As another non-limiting example, the end of pins 102 may be deformed or have a larger dimension than that of hole 132 such that deflector carrier 24 cannot be removed therefrom. Additional non-limiting exemplary methods to secure the deflector to the carrier include: a threaded hole with a screw/bolt, welding, solder, adhesive, press-fit/friction fit, cold head, and the like.

Deflector 22 may be generally circular and may have an outer periphery defined by a plurality of projecting tines 136 with slots 138 therebetween. The shape of deflector 22 along with the number and dimensions of tines 136 and the number and dimensions of slots 138 may be configured to provide a desired distribution pattern for a fire suppressant flowing thereacross. An upper surface 140 of deflector 22 may be curved as it extends from a center of deflector 22 outwardly toward tines 136. Deflector 22 includes a central opening 142 configured to receive lower portion 126 of central section 120 of deflector carrier 24. Deflector 22 can be secured to deflector carrier 24 with a mechanical fastener 144, such as a screw or a deformed portion, that engages with central section bore 122. Fastener 144 can thereby retain deflector 22 secured to deflector carrier 24. As a result, deflector 22 is spaced downwardly and away from deflector carrier 24 and also downwardly and away from pins 102.

Deflector carrier 24 not only spaces deflector 22 downwardly and away from pins 102, but also serves to provide a desired flow of fire suppressant thereacross and onto upper surface 140 of deflector 22. In particular, the upper portions 148 of each wing 128 taper as they extend upwardly toward body 28. Each wing 128 includes opposite first and second surfaces 150, 152 that taper toward one another as they extend upwardly toward body 28. First and second surfaces 150, 152 meet at an edge 154 that defines the apex or top of wings 128. Edge 154 is thereby the leading edge that is encountered by the fire suppressant fluid as it flows over deflector carrier 24 and onto deflector 22. Edge 154 may be substantially flush with flat upper surface 121 of central section 120. Edge 154 is closer to the outlet of body 28 than ends 130 of wings 128 at all times. Upper portions 148 of wings 128 also include a curving transitional surface 155 which extends from leading edge 154 to the flat surface 131 of ends 130. Edge 154 serves to cut through the fire suppressant flow while first and second surfaces 150, 152 and transitional surfaces 155 gradually separate the flow on the opposite sides of deflector carrier 24 as the flow extends downwardly past deflector carrier 24 and onto deflector 22. First and second intermediate surfaces 158, 160 of lower portion 156 of each wing 128 may extend generally parallel with one another thereby forming spaced apart parallel planar surfaces. First and second lower surfaces 159, 161 may taper toward one another as they extend downwardly to a lower (trailing) edge 162 of wings 128. The tapering of first and second lower surfaces 159, 161 toward one another to form lower edge 162 can facilitate the joining of the flow of fire suppressant back toward one another as it extends downwardly beyond deflector carrier 24.

The thickness $T_1$ of wings 128 can be less than a thickness $T_2$ of ends 130 (FIG. 12). In particular, ends 130 have a thickness $T_2$ sufficient to receive pins 102 and be secured thereto. In contrast, wings 128 can be thinner to provide a reduced impact on the dividing of the flow of the fire suppressant across deflector carrier 24. The transition from the thin portion of wings 128 to the thicker ends 130 can include first and second tapering surfaces 164, 166.

The generally conical central section 120 of deflector carrier 24 can also have a greater exterior dimension than that of wings 128 to accommodate fastener 144 to secure deflector 22 to deflector carrier 24. The exterior surface of central section 120 can gradually enlarge as it extends downwardly to provide a smooth transition for the fire suppressant as it flows across central section 120 of deflector carrier 24.

As stated above, deflector carrier 24 maintains deflector 22 a pre-selected distance downwardly and below deflector carrier 24. Specifically, upper surface 140 of deflector 22 is spaced a distance D below leading edge 154 of deflector carrier 24. The distance D between leading edge 154 and upper surface 140 helps prevent the possibility of components of sprinkler 20 that reside above deflector carrier 24, such as the components of seal closure assembly 54, adjustment plate 62, plates 76, 78, and levers 64, from being trapped or pinned against deflector carrier 24 and deflector 22 by the fire suppressant fluid when sprinkler 20 is activated. In particular, if one of these components is simultaneously contacting both upper surface 140 and leading edge 154, there is a possibility for that component to be trapped or pinned there against due to the force of the fire suppressant fluid. By maintaining a minimum distance D between these surfaces, the propensity for a component getting trapped thereagainst is reduced. The dimension D may be greater than the largest dimension of the components that reside above deflector carrier 24 and are released when sprinkler 20 is activated. Additionally, the shape of leading edge 154 in conjunction with the use of transitional surfaces 155 leading to ends 130 of wings 128 also helps prevent the possibility of a component being pinned thereagainst. The dimension D along with the configuration of deflector carrier 24 can be created such that the components of sprinkler 20 that are released and discharged during operation cannot simultaneously touch both the leading edge 154 and/or transitional surfaces 155 of deflector carrier 24 and upper surface 140 of deflector 22.

In operation, sprinkler 20 is installed in an assembled and ready position, such as that shown in FIGS. 1-2 and 5-6. Gap 38 and openings 34 in cup 26 allow air flow to flow through the interior of cup 26 and in fluid contact with the components retaining plate 37 to cover assembly 36 along with the components of trigger device 70. When the heat-fusible material retaining plate 37 of cover assembly 36 to cup 26 is elevated to a pre-selected temperature due to the presence of fire, its chemical degradation or reduction in bonding strength, coupled with the force of the spring clips, plate 37 will be released and fall, via gravity, away from sprinkler 20. With plate 37 released and fallen away, deflector 22 and deflector carrier 24 will also fall away from sprinkler 20 as pins 102 slide within openings 100 in projections 98 of frame arms 96. Heads 108 of pins 102 limit the downward travel of deflector 22 and deflector carrier 24 relative to sprinkler 20.

When the temperature of the heat-fusible material utilized in trigger device 70 is elevated to a pre-selected temperature due the presence of fire, its chemical degradation or reduction in bonding strength, coupled with the force exerted on plates 76, 78 by levers 64, first fusible plate 76 separates from second fusible plate 78. This, in turn, releases adjustment plate 62 causing the fire suppressant fluid to discharge seal closure assembly 54 and begin flowing out through first and second passageways 46, 50 of body 28. Deflector carrier 24 and deflector 22, if not already in the fully extended position, would be contacted by the fire suppressant fluid and be pushed downwardly into the fully extended position, such as that shown in FIG. 4. Thereafter, the trajectory of the fire suppressant fluid is altered by deflector carrier 24 prior to contacting upper surface 140 of deflector 22. The fire suppressant fluid flows along upper surface 140 and encounters projections 136 and gaps 138. The fire suppressant fluid may have a tendency to re-group or re-join after passing across deflector carrier 24. The fire suppressant fluid then flows off of deflector 22 to provide a desired distribution pattern for the fire suppressant fluid.

The maintaining of deflector 22 downwardly spaced apart from deflector carrier 24 eliminates the possibility of pins 102 causing a shadow effect or voids in the distribution pattern. The shape of deflector carrier 24 reduces the impact on the fire suppressant flowing therethrough and also reduces the possibility of a component of sprinkler 20 being lodged thereagainst and impeding the flow of the fire suppressant fluid.

A sprinkler 20 according to the present disclosure can be configured and designed to meet a variety of fire suppression capabilities. For example, the dimensions of cover assembly 36 along with the performance of the heat-fusible material holding plate 37 to cover assembly 36 and that utilized in trigger device 70 may have suitable response characteristics to meet an extended coverage, light hazard service rating. The response characteristics may be sufficient to meet an extended coverage, ordinary hazard service rating. Additionally, sprinkler 20 may be sized to have various K values. By way of non-limiting example, sprinkler 20 can have a K-factor range of 2.8 to 28.0. The use of deflector carrier 24 can enable the use of a concealed drop-down sprinkler with larger K values due to the separation of pins 102 from deflector 22. In particular, as the K value increases, the fluid flow through sprinkler 20 also increases thereby increasing the force of the fire suppressant fluid contacting deflector 22. The greater force may require the use of pins 102 of a larger diameter. The larger diameter pins, if directly connected to deflector 22, would create an even larger shadow effect and additional or larger voids in the flow distribution pattern. By separating pins 102 from deflector 22, the effect of the larger diameter pins is avoided in the sprinkler 20 according to the present disclosure.

It is to be understood that the foregoing is a description of the preferred embodiment. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention. Those skilled in the art will recognize that variations, modifications, and improvements may be made without departing from the spirit and scope of the invention disclosed herein. For example, the artisan with ordinary skill will readily understand that a deflector carrier 24 may be utilized with sprinklers having internal components which differ from those depicted. Pins 102, while being shown and described as being cylindrical, can take other forms. Consequently, the scope or protection afforded the present disclosure is to be measured by the claims which follow in the breath of interpretation which the law allows.

What is claimed is:

1. An automatic fire protection sprinkler comprising:

a sprinkler body having an axially extending passageway with an outlet through which a fire suppressant fluid flows;

a deflector carrier axially moveable relative to the body between a first position distal of the outlet and a second position distal of the first position, the deflector carrier having a radially extending leading edge facing the outlet and a pair of mounting locations distal of the leading edge;

a pair of guide pins reciprocally coupled to the sprinkler body on opposite sides of the outlet for movement between a first retracted position and a second extended position and having axially opposite first and second ends, the pair of guide pins coupled to the deflector carrier at the pair of mounting locations, the pair of guide pins moveably coupling the deflector carrier to the sprinkler body between the first retracted position and the second extended position; and a deflector attached to the deflector carrier and moving with the deflector carrier between the first and second positions, the deflector distributing fire suppressant fluid thereon into a flow distribution pattern, wherein the deflector carrier maintains the deflector distally spaced away from and downstream of the pair of guide pins and the leading edge is closer to the outlet than the mounting location in both of the first and second positions.

2. The automatic fire protection sprinkler as recited in claim 1, further comprising a housing having an interior and wherein at least a portion of the sprinkler body is located in the interior of the housing, the deflector is located in the interior of the housing when in the first position, and the deflector is located outside of the interior of the housing when in the second position.

3. An automatic fire protection sprinkler comprising:

a sprinkler body having an axially extending passageway with an outlet through which a fire suppressant fluid flows;

a deflector carrier axially moveable relative to the body between a first position distal of the outlet and a second position distal of the first position, the deflector carrier having a radially extending leading edge facing the outlet and a mounting location distal of the leading edge;

at least one guide member coupled to the sprinkler body and having axially opposite first and second ends, the at least one guide member coupled to the deflector carrier at the mounting location, the at least one guide member moveably coupling the deflector carrier to the sprinkler body; and a deflector attached to the deflector carrier and moving with the deflector carrier between the first and second positions, the deflector distributing fire suppressant fluid thereon into a flow distribution pattern, wherein the deflector carrier maintains the deflector distally spaced away from and downstream of the at least one guide member and the leading edge is closer to the outlet than the mounting location in both of the first and second positions, further comprising a sealing assembly and a heat-activated trigger device disposed between the deflector carrier and the outlet of the sprinkler body, the sealing assembly sealing the outlet and the trigger device releasing the sealing assembly from sealing engagement with the outlet when a pre-selected temperature is realized, and wherein the deflector carrier is separate and distinct from the sealing assembly and the trigger device.

4. The automatic fire protection sprinkler as recited in claim 3, wherein the deflector is distally spaced away from the leading edge a distance that prevents components of the sealing assembly and trigger device from simultaneously contacting the leading edge and the deflector when falling due to activation of the trigger device.

5. An automatic fire protection sprinkler comprising:

a sprinkler body having an axially extending passageway with an outlet through which a fire suppressant fluid flows;

a deflector carrier axially moveable relative to the body between a first position distal of the outlet and a second position distal of the first position, the deflector carrier having a radially extending leading edge facing the outlet and a mounting location distal of the leading edge;

at least one guide member coupled to the sprinkler body and having axially opposite first and second ends, the at least one guide member coupled to the deflector carrier at the mounting location, the at least one guide member moveably coupling the deflector carrier to the sprinkler body; and a deflector attached to the deflector carrier and moving with the deflector carrier between the first and second positions, the deflector distributing fire suppressant fluid thereon into a flow distribution pattern, wherein the deflector carrier maintains the deflector distally spaced away from and downstream of the at least one guide member and the leading edge is closer to the outlet than the mounting location in both of the first and second positions, wherein the at least one guide member is a pair of guide members, the deflector carrier includes a central section and a pair of wings extending radially outwardly from the central section in opposite directions, the wings each having an end section that together define a pair of the mounting locations to which the pair of guide members are coupled, the wings taper as they extend axially toward the outlet and form a pair of leading edges, and each wing has a transitional surface that curves as it extends from the leading edge to a planar surface of the end section facing the outlet.

6. The automatic fire protection sprinkler as recited in claim 5, wherein the central section includes a relatively flat surface facing the outlet and the flat surface and the leading edges are substantially flush with one another.

7. The automatic fire protection sprinkler as recited in claim 6, wherein the central section is generally frusto-conical in shape and has an increasing diameter as the central section extends axially away from the outlet.

8. An automatic fire protection sprinkler comprising:

a sprinkler body having an axially extending passageway with an outlet through which a fire suppressant fluid flows;

a deflector carrier axially moveable relative to the body between a first position distal of the outlet and a second position distal of the first position, the deflector carrier having a radially extending leading edge facing the outlet and a mounting location distal of the leading edge;

at least one guide pin reciprocally coupled to the sprinkler body for movement between a first retracted position and a second extended position and having axially opposite first and second ends, the at least one guide pin coupled to the deflector carrier at the mounting location, the at least one guide pin moveably coupling the deflector carrier to the sprinkler body between the first retracted position and the second extended position; and a deflector attached to the deflector carrier and moving with the deflector carrier between the first and second positions, the deflector distributing fire suppressant fluid thereon into a flow distribution pattern, wherein the deflector carrier maintains the deflector distally spaced away from and downstream of the at least one guide pin and the leading edge is closer to the outlet than the mounting location in both of the first and second, wherein the body includes at least one axially extending arm with an end that is distal the outlet and the at least one guide pin is coupled to the end of the at least one arm and axially moveable relative thereto.

9. An automatic fire protection sprinkler comprising:

a sprinkler body having an axially extending passageway with an outlet through which a fire suppressant fluid flows;

a deflector carrier axially moveable relative to the body between a first position distal of the outlet and a second position distal of the first position, the deflector carrier having a radially extending leading edge facing the outlet and a mounting location distal of the leading edge;

at least one guide member coupled to the sprinkler body and having axially opposite first and second ends, the at least one guide member coupled to the deflector carrier at the mounting location, the at least one guide member moveably coupling the deflector carrier to the sprinkler body; and a deflector attached to the deflector carrier and moving with the deflector carrier between the first and second positions, the deflector distributing fire suppressant fluid thereon into a flow distribution pattern, wherein the deflector carrier maintains the deflector distally spaced away from and downstream of the at least one guide member and the leading edge is closer to the outlet than the mounting location in both of the first and second positions, wherein the at least one guide member is a pair of guide members, the deflector carrier includes a central section and a pair of wings extending radially outwardly from the central section in opposite directions, the wings each having an end section that together define a pair of the mounting locations to which the pair of guide members are coupled, the wings each having opposite first and second radially facing surfaces, the first and second surfaces each include an uppermost portion that taper toward one another as they extend axially toward the outlet and form an upper apex that defines a pair of leading edges, the first and second surfaces each include a lowermost portion that taper toward one another as they extend axially away from the outlet and form a lower apex that defines a pair of trailing edges, and the first and second surfaces each include an intermediate portion between the uppermost and lowermost portions that define a pair of parallel planar surfaces.

10. The automatic fire protection sprinkler as recited in claim 1, wherein the sprinkler has a K-factor range of 2.8 to 28.0.

11. An automatic fire protection sprinkler comprising:

a sprinkler body having an axially extending passageway with an outlet through which a fire suppressant fluid flows;

a deflector carrier axially moveable relative to the body between a first position distal of the outlet and a second position distal of the first position, the deflector carrier having a central section and a pair of wings extending radially outwardly from the central section in opposite directions, the wings each having an end section that together define a pair of mounting locations;

a pair of guide members coupled to the sprinkler body and having axially opposite first and second ends, the guide members coupled to the deflector carrier at the mounting locations, the guide members moveably coupling the deflector carrier to the sprinkler body; and a deflector attached to the deflector carrier and moving with the deflector carrier between the first and second positions, the deflector distributing fire suppressant fluid thereon into a flow distribution pattern, wherein the deflector carrier maintains the deflector distally spaced away from and downstream of the at least one guide member, the wings each have an uppermost section defined by a pair of radially spaced apart surfaces that taper toward one another as they extend axially toward the outlet and define a leading edge, the wings each have a lowermost section defined by a pair of radially spaced apart surfaces that taper toward one another as they extend axially away from the outlet and define a trailing edge, and each of the wings includes a pair of radially spaced apart intermediate generally parallel planar surfaces between the uppermost and lowermost sections.

12. The automatic fire protection sprinkler as recited in claim 11, further comprising a housing having an interior and wherein at least a portion of the sprinkler body is located in the interior of the housing, the deflector is located in the interior of the housing when in the first position, and the deflector is located outside of the interior of the housing when in the second position.

13. The automatic fire protection sprinkler as recited in claim 11, further comprising a sealing assembly and a heat-activated trigger device disposed between the deflector carrier and the outlet of the sprinkler body, the sealing assembly sealing the outlet and the trigger device releasing the sealing assembly from sealing engagement with the outlet when a pre-selected temperature is realized, and wherein the deflector carrier is separate and distinct from the sealing assembly and the trigger device.

14. The automatic fire protection sprinkler as recited in claim 13, wherein the deflector is distally spaced away from the leading edge a distance that prevents components of the sealing assembly and trigger device from simultaneously contacting the leading edge and the deflector when falling due to activation of the trigger device.

15. The automatic fire protection sprinkler as recited in claim 11, wherein each wing has a transitional surface that curves as it extends from the leading edge to a planar surface of the end section facing the outlet.

16. The automatic fire protection sprinkler as recited in claim 11, wherein the central section includes a relatively flat upper surface facing the outlet and the flat upper surface and the leading edges are substantially flush with one another.

17. The automatic fire protection sprinkler as recited in claim 16, wherein the central section is generally frusto-conical in shape and has an increasing diameter as the central section extends axially away from the outlet.

18. The automatic fire protection sprinkler as recited in claim 11, wherein the body includes a pair of axially extending arms each having an end that is distal the outlet and the pair of guide members is coupled to the ends of the pair of arms and is axially moveable relative thereto.

19. The automatic fire protection sprinkler as recited in claim 11, wherein the leading edge is closer to the outlet than the mounting locations in both of the first and second positions.

20. The automatic fire protection sprinkler as recited in claim 11, wherein the sprinkler has a K-factor range of 2.8 to 28.0.

* * * * *